US012016469B2

(12) United States Patent
Anokhin et al.

(10) Patent No.: US 12,016,469 B2
(45) Date of Patent: Jun. 25, 2024

(54) CONVERTIBLE CHILD CHAIR

(71) Applicant: Skip Hop, Inc., New York, NY (US)

(72) Inventors: Vladimir Anokhin, East Brunswick, NJ (US); Benjamin Bearsch, Brooklyn, NY (US)

(73) Assignee: Skip Hop, Inc., New York, NY (US)

( * ) Notice: Subject to any disclaimer, the term of this patent is extended or adjusted under 35 U.S.C. 154(b) by 200 days.

(21) Appl. No.: 17/408,453

(22) Filed: Aug. 22, 2021

(65) Prior Publication Data

US 2023/0055274 A1 Feb. 23, 2023

(51) Int. Cl.
*A47D 1/00* (2006.01)
*A47D 15/00* (2006.01)

(52) U.S. Cl.
CPC ..... *A47D 1/004* (2013.01); *A47D 1/0085* (2017.05); *A47D 15/006* (2013.01)

(58) Field of Classification Search
CPC ..... A47D 1/0081; A47D 1/023; A47D 1/00
See application file for complete search history.

(56) References Cited

U.S. PATENT DOCUMENTS 4,714,292 A 12/1987 Kassai
5,335,754 A * 8/1994 Gibson ..... E06C 7/44 182/205
5,527,090 A * 6/1996 Cone, II ..... A47D 1/0081 297/149
5,806,922 A 9/1998 Medelovich
6,089,654 A * 7/2000 Burstein ..... A47D 1/08 297/133
6,126,236 A 10/2000 Wu
6,692,070 B1 2/2004 Hou et al.
6,932,426 B2 * 8/2005 Greger ..... A47D 1/0085 297/149
7,490,895 B2 2/2009 Yeh
7,673,934 B2 3/2010 Bearup et al.
7,690,731 B2 4/2010 Kuester
8,029,053 B2 10/2011 Troutman et al.
8,863,902 B2 * 10/2014 Lanzafame ..... E06C 1/397 182/129
9,119,481 B2 * 9/2015 Varney ..... A47D 1/0081
9,635,955 B2 5/2017 Greger
9,986,850 B2 6/2018 Haut et al.
10,624,458 B2 4/2020 Turowski et al.
11,039,694 B2 6/2021 Ingraham et al.
2002/0074835 A1 * 6/2002 Chalender ..... A47D 13/102 297/118

(Continued)

FOREIGN PATENT DOCUMENTS

CN 2803145 Y 8/2006
CN 202222839 U 5/2012

(Continued)

*Primary Examiner* — Sarah B McPartlin
(74) *Attorney, Agent, or Firm* — Greenberg Traurig, LLP

(57) ABSTRACT

A convertible child chair converts between multiple heights, including a high chair, a child seat, and a booster seat, through simple reconfiguration of a leg assembly of the chair. A belly band may be removably coupled to a seat of the child chair. A tray may be removably coupled to the child seat and may have an adjustable depth while remaining coupled to the chair. A footrest may be removably coupled to the chair and may have a adjustable height by removing the footrest and flipping the footrest.

13 Claims, 15 Drawing Sheets

(56) References Cited

U.S. PATENT DOCUMENTS

| | | | | |
|---|---|---|---|---|
| 2008/0088162 | A1* | 4/2008 | Fritz | A47D 1/0081 297/119 |
| 2008/0179921 | A1 | 7/2008 | Lake et al. | |
| 2016/0174727 | A1* | 6/2016 | Haut | A47D 1/103 297/130 |
| 2020/0352349 | A1 | 11/2020 | Tuckey | |

FOREIGN PATENT DOCUMENTS

| | | | |
|---|---|---|---|
| CN | 101961183 | B | 8/2013 |
| CN | 203914217 | U | 11/2014 |
| CN | 204889345 | U | 12/2015 |
| CN | 303609784 | S | 3/2016 |
| CN | 205267617 | U | 6/2016 |
| CN | 104720431 | B | 4/2017 |
| CN | 206275484 | U | 6/2017 |
| CN | 107736760 | A | 2/2018 |
| CN | 108784128 | A | 11/2018 |
| CN | 208274430 | U | 12/2018 |
| CN | 109832877 | A | 6/2019 |
| CN | 111280946 | A | 6/2020 |
| CN | 213282316 | U | 5/2021 |
| CN | 112932177 | A | 6/2021 |
| DE | 202016003663 | U1 | 9/2016 |
| EP | 1792552 | B1 | 8/2009 |
| EP | 2305076 | B1 | 10/2014 |
| GB | 211787 | A | 2/1924 |
| GB | 2459491 | A | 10/2009 |
| GB | 2578671 | A | 5/2020 |
| KR | 20150002738 | U | 7/2015 |
| RU | 192686 | U9 | 1/2020 |
| WO | 2007052077 | A1 | 5/2017 |

* cited by examiner

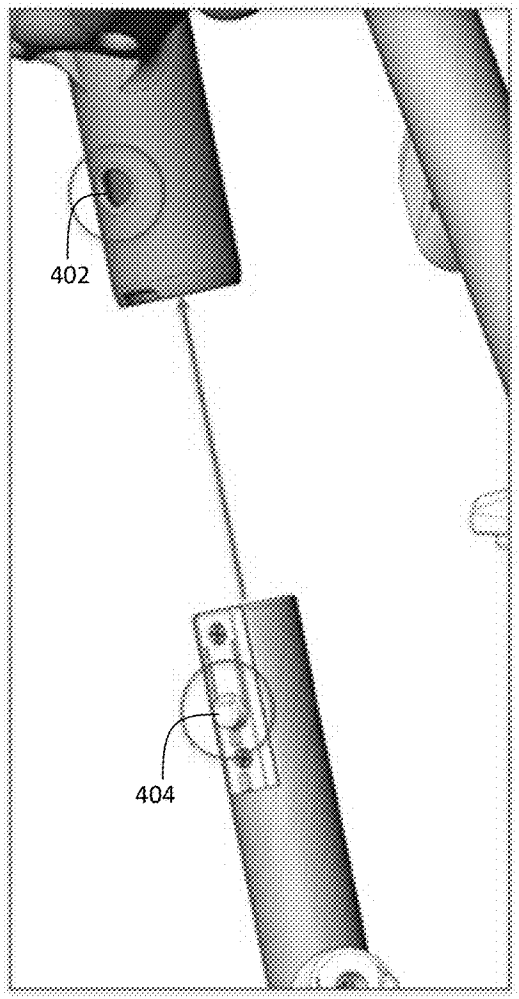
FIG. 4
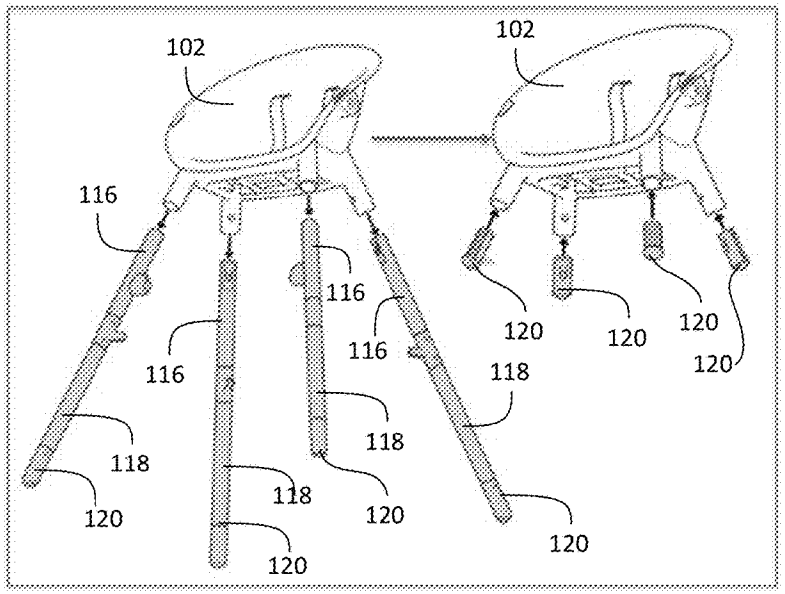
FIG. 3
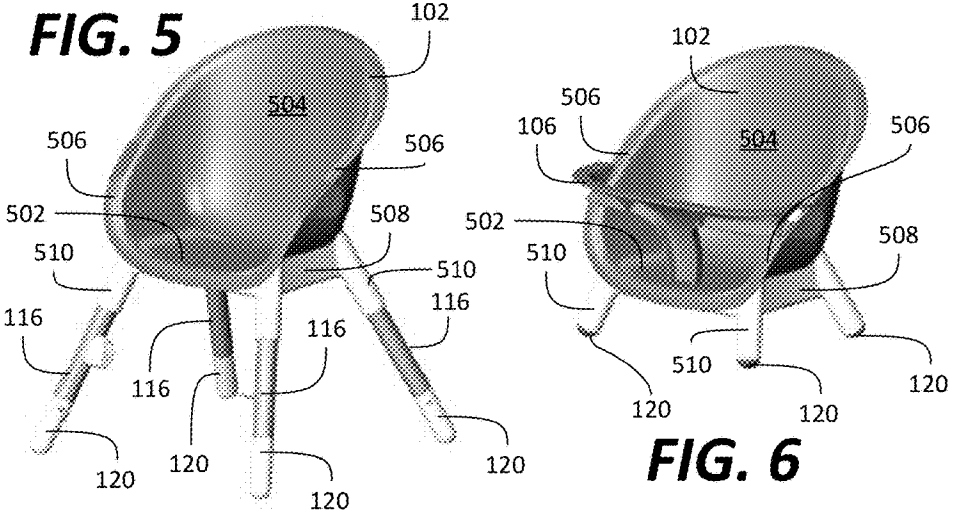
FIG. 5
FIG. 6

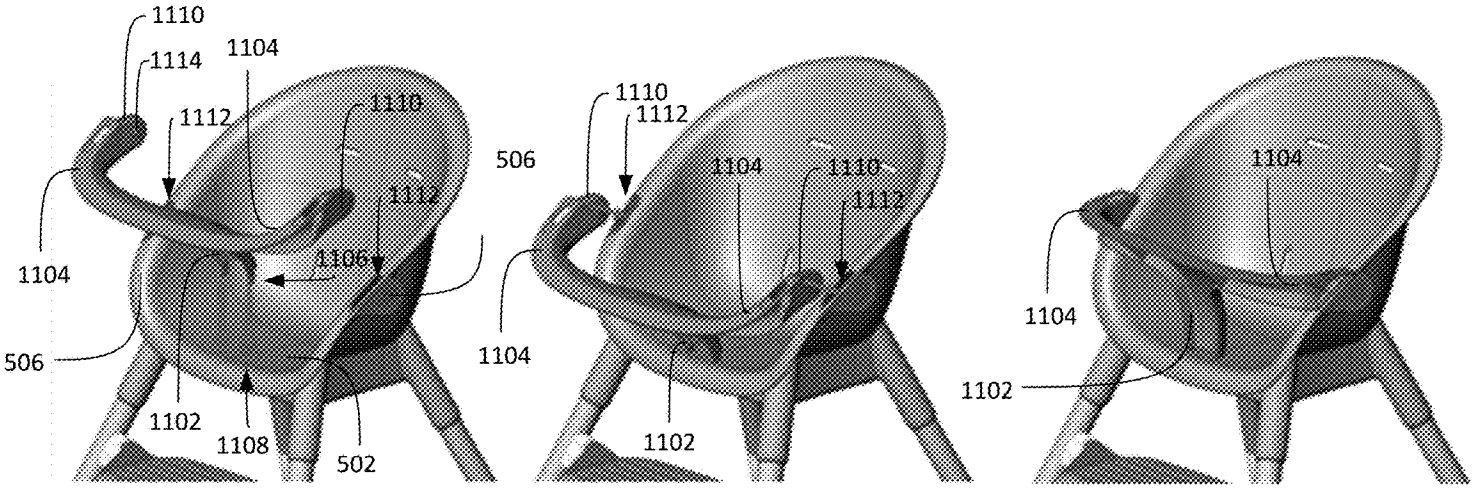
FIG. 11A
FIG. 11B
FIG. 11C
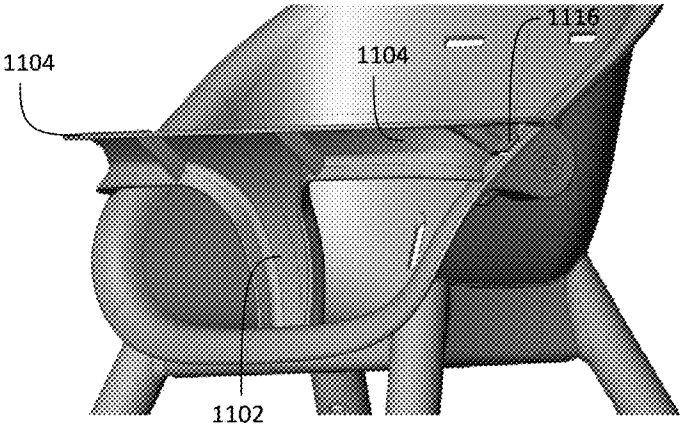
FIG. 11D

CONVERTIBLE CHILD CHAIR

FIELD OF THE DISCLOSURE

The instant disclosure relates to a convertible child chair.

BACKGROUND

A child chair may provide a secure seat for a child, and may additionally include a surface on which a child may eat (e.g., a tray).

SUMMARY

In a first aspect of the present disclosure, a child chair is provided. The child chair includes a seat body, a retainer band removably coupled with the seat body, the retainer band configured to retain a child in the seat body when the retainer band is coupled with the seat body, a runner removably coupled with the retainer band, and a tray, coupled to the runner and configured to slide along the runner to adjust a depth of the tray from the seat body.

In an embodiment of the first aspect, the runner is a first runner removably coupled to a first lateral side of the retainer band, and the child chair further includes a second runner removably coupled with a second lateral side of the retainer band, the tray coupled to the first and second runners and configured to slide along the runners to adjust the depth of the tray from the seat body.

In an embodiment of the first aspect, the chair further includes a tray assembly, the tray assembly including the tray, the runner, a latch configured to secure the tray assembly to the retainer band, and a release button coupled to the latch and configured to release the latch responsive to user actuation of the button. In a further embodiment of the first aspect, the tray assembly further includes a base portion comprising the runner and the latch, the base portion configured to be coupled to the retainer band in a fixed position.

In an embodiment of the first aspect, the retainer band includes a first lateral portion and a second lateral portion, each of the first and second lateral portions configured to be removably coupled with the seat body, and a central portion, configured to be removably coupled with a seat portion of the seat body, wherein the first and second lateral portions extend laterally from the central portion. In a further embodiment of the first aspect, the first and second lateral portions are configured to be removably coupled with first and second lateral portions of the seat body.

In an embodiment of the first aspect, the chair further includes a leg assembly comprising a plurality of legs, each leg including a lower portion and an upper portion, wherein the upper portion is removably coupled with the seat body, wherein the lower portion is selectively removably coupled with the upper leg portion and with the seat body. In a further embodiment of the first aspect, the leg assembly further includes a cross-member assembly, the cross-member assembly configured to be coupled between the upper portion and the lower portion of each of the plurality of legs, the cross-member assembly including a plurality of cross-members, each extending between two respective legs when the cross-member assembly is coupled with the legs. In a further embodiment of the first aspect, each leg further includes a foot, wherein the foot is selectively removably coupled with the upper leg portion and with the lower leg portion. In a further embodiment of the first aspect, the chair further includes a first leg defining a first slot and a second leg defining a second slot and a footrest configured to be removably coupled to the first and second legs, the footrest including a first projection configured to removably mate with the slot of the first leg, and a second projection configured to removably mate with the slot of the second leg.

In an embodiment of the first aspect, the chair further includes a first leg defining a first slot and a second leg defining a second slot and a footrest configured to be removably coupled to the first and second legs, the footrest including a first projection configured to removably mate with the slot of the first leg, and a second projection configured to removably mate with the slot of the second leg. In a further embodiment of the first aspect, the first projection and the second projection are configured to mate with the first and second slots in a first orientation in which the footrest is a first height and a second orientation in which the footrest is a second height.

In a second aspect of the present disclosure, a child chair is provided. The chair includes a seat body and a leg assembly coupled to the seat body, the leg assembly including a plurality of legs, each leg including a lower portion and an upper portion, wherein the upper portion is removably coupled with the seat body, wherein the lower portion is selectively removably coupled with the upper leg portion and with the seat body, and a foot, wherein the foot is selectively removably couplable with the upper leg portion and with the lower leg portion; and a cross-member assembly, the cross-member assembly configured to be coupled between the upper portion and the lower portion of each of the plurality of legs, the cross-member assembly comprising a plurality of cross-members, each extending between two respective legs when the cross-member assembly is coupled with the legs.

In an embodiment of the second aspect, each foot is further selectively removable couplable with the seat body.

In an embodiment of the second aspect, the cross-member assembly includes a plurality of leg receivers, each leg receiver configured to couple with the upper portion and lower portion of a respective leg, and each cross-member includes a finger configured to be inserted into a leg receiver, and a cover configured to cover the coupling of the finger and leg receiver.

In an embodiment of the second aspect, the chair further includes a footrest configured to be removably coupled to first and second legs of the plurality of legs, the footrest including a first projection configured to removably mate with a slot of the first leg, and a second projection configured to removably mate with a slot of the second leg.

In a third aspect of the present disclosure, a child chair is provided. The child chair includes a seat body, a first leg, coupled to the seat body, defining a first slot, a second leg, coupled to the seat body, defining a second slot, a footrest configured to be removably coupled to the first and second legs, the footrest including a first projection configured to removably mate with the slot of the first leg, and a second projection configured to removably mate with the slot of the second leg.

In an embodiment of the third aspect, the first projection and the second projection are configured to mate with the first and second slots in a first orientation in which the footrest is a first height and a second orientation in which the footrest is a second height. In a further embodiment of the third aspect, the footrest further includes a base portion on which a user of the chair may rest the user's feet, the base portion vertically offset with respect to the first and second projections, whereby the base portion has the first height in the first orientation and the second height in the second orientation.

In an embodiment of the third aspect, the first and second slots are vertical slots with an open upper portion to permit the projections to be removed and inserted and a closed lower portion to retain the inserted projections.

BRIEF DESCRIPTION OF THE DRAWINGS

FIG. 3 illustrates a conversion of the child chair of FIG. 1 from a high chair configuration to a booster seat configuration.

FIG. 4 is an enlarged view of a coupling of a leg portion with a seat body of the child chair of FIG. 1.

FIG. 5 is a perspective view of the convertible child chair of FIG. 1 in a child seat configuration.

FIG. 6 is a perspective view of the convertible child chair of FIG. 1 in a booster seat configuration.

FIGS. 11A-11D are various views of a portion of the convertible child chair of FIG. 1, illustrating an installation process and features of a retainer band.

DETAILED DESCRIPTION

A convertible child chair may improve upon known chairs by easily transitioning between a high chair configuration, a child seat configuration, and a booster seat configuration through a leg assembly that is simple to securely assemble and disassemble through the use of identical coupling features on multiple leg components. The convertible child chair may further improve upon known child chairs by including a removable lap band (referred to herein as a retainer band) and a removable tray assembly that enable additional configurations at any height configuration. Still further, the convertible child chair may improve upon known child chairs by including a footrest that easily converts between heights.

Figure 2:
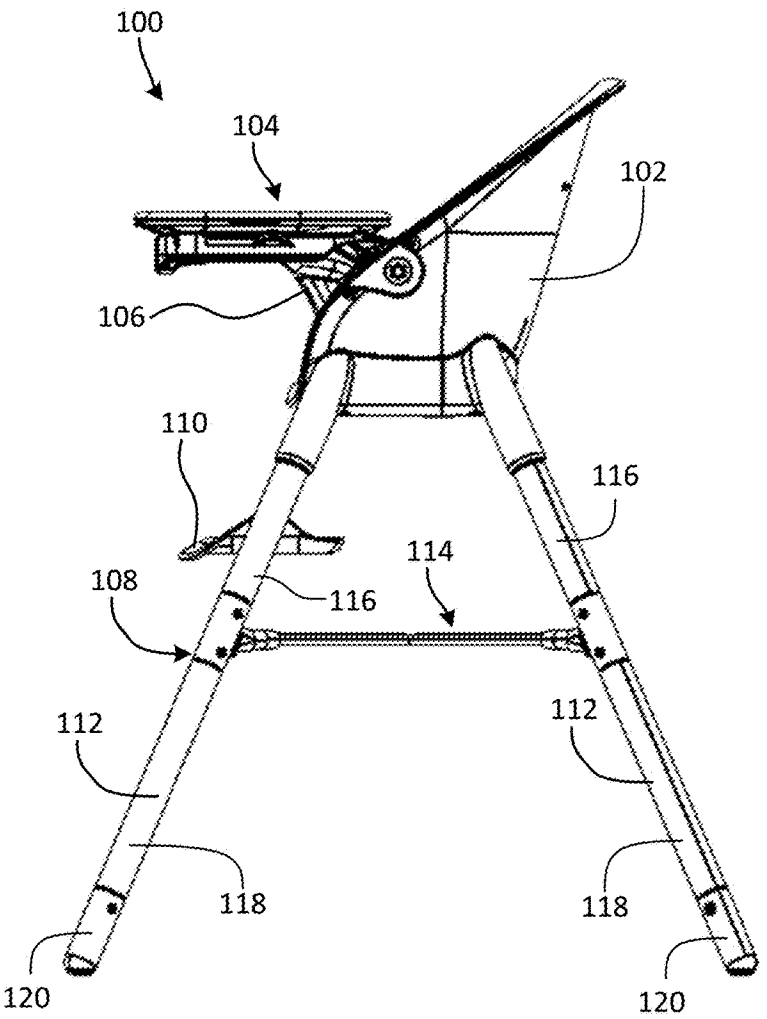
FIG. 2 is a side view of the convertible child chair of FIG. 1.
Figure 1:
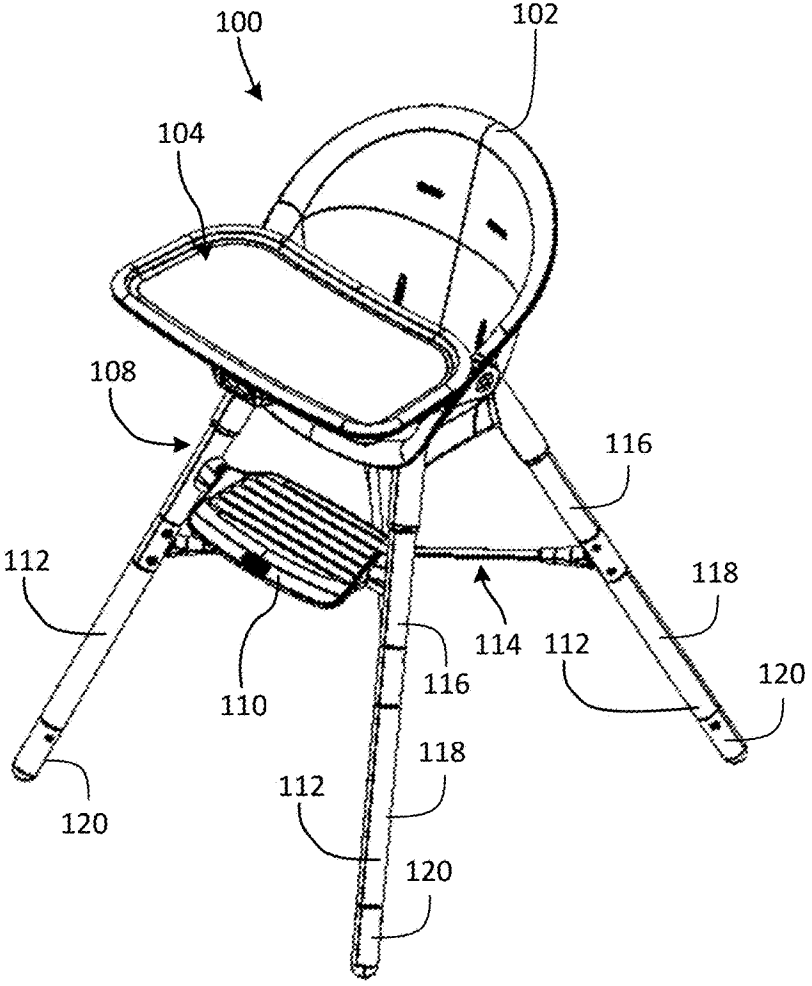
FIG. 1 is a perspective view of an example convertible child chair.

Referring to the drawings, wherein like numerals refer to the same or similar features in the various views, FIGS. 1 and 2 illustrate an example convertible child chair 100. The chair 100 may include a seat body 102, a tray assembly 104, a retainer band 106, a leg assembly 108, and a footrest 110. The chair 100 may be convertible between multiple different configurations by virtue of removably or separably coupled components. For example, the leg assembly 108 may have multiple configurations to convert the chair 100 between a high chair configuration, a child seat configuration, and a booster seat configuration. In another example, the tray assembly 104 and/or retainer band 106 may be removably coupled to the chair 100 in one or more of the height configurations. In another example, the footrest 110 may be coupled to the leg assembly 108 in multiple orientations with different heights of the footrest 110 at each orientation.

FIGS. 3-6 illustrate various aspects and configurations of the chair 100. Specifically, FIG. 3 illustrates a conversion of the chair 100 from a high chair configuration to a booster seat configuration. Referring to FIGS. 1-3, the leg assembly 108 may include a plurality of legs 112 (four legs are shown) and a cross-member assembly 114. Each leg 112 may include an upper portion 116, a lower portion 118, and a foot 120. The upper portion 116, lower portion 118, and feet 120 may be selectively removably coupled together, and to the seat body 102, to convert the chair 100 from one height to another. For example, as shown in FIG. 3, to convert from a high chair configuration to a booster seat configuration, the upper leg portions 116 may be uncoupled from the seat body 102, the feet 120 may be uncoupled from the lower leg portions 118, and the feet 120 may be coupled with the seat body 102. FIG. 6 illustrates the final form of the booster seat configuration.

To convert from the high chair configuration to the child seat configuration, the lower leg portions 118 may be uncoupled from the upper leg portions 116, the feet 120 may be uncoupled from the lower leg portions 118, and the feet 120 may be coupled with the upper leg portions 116. FIG. 5 illustrates the final form of the child seat configuration.

The upper leg portions 116, the lower leg portions 118, and the feet 120 may include identical coupling mechanisms, in some embodiments, to enable the modular configurations discussed above. Similarly, the seat body 102, upper leg portions 116, and lower leg portions 118 may include identical coupling mechanisms for the same reason. In some embodiments, the upper leg portions 116 and lower leg portions 118 may be configured to be coupled with an intermediate component (e.g., of a cross-member assembly, as will be discussed below).

FIG. 4 illustrates example coupling mechanisms that may be identically included on two or more of the seat body 102, upper leg portion 116, lower leg portion 118, and/or feet 120. For example, the seat body 102 (specifically, a leg receiving portion of the seat), upper leg portions 116, and lower leg portions 118 may each include a lateral aperture 402, and the upper leg portions 116, lower leg portions 118, and feet 120 may each include a compressible button 404 for coupling with an aperture 402. Accordingly, the compressible button 404 of a foot 120, of an upper leg portion 116, or of a lower leg portion 118 may be selectively removably coupled with the aperture 402 of the seat body 102, the upper leg portion 116, or the lower leg portion 118.

Referring to FIGS. 5 and 6, the seat body 102 may include a seat portion 502, a back portion 504, two lateral portions 506, and a leg coupling portion 508. The leg coupling portion 508 may include a plurality of leg receiving portions 510 (two of which are labelled in FIGS. 5 and 6 for visual clarity) that is equal to the quantity of legs in the leg assembly 108 (four such legs are included in the illustrated embodiment). Accordingly, in the illustrated embodiment, the leg coupling portion 508 includes four leg receiving portions 510, each of which includes a generally tubular passageway with at least one sidewall, the sidewall defining an aperture 402 as described above. The seat portion 502 may be disposed on top of the leg coupling portion 508, the back portion 504 may extend upward from the seat portion 502, and the lateral portions 506 may extend upward from the seat portion 502 and forward from the back portion 504. The lateral portions 506 may define the lateral sides of a space in which a child may sit in the chair.

Figure 7:
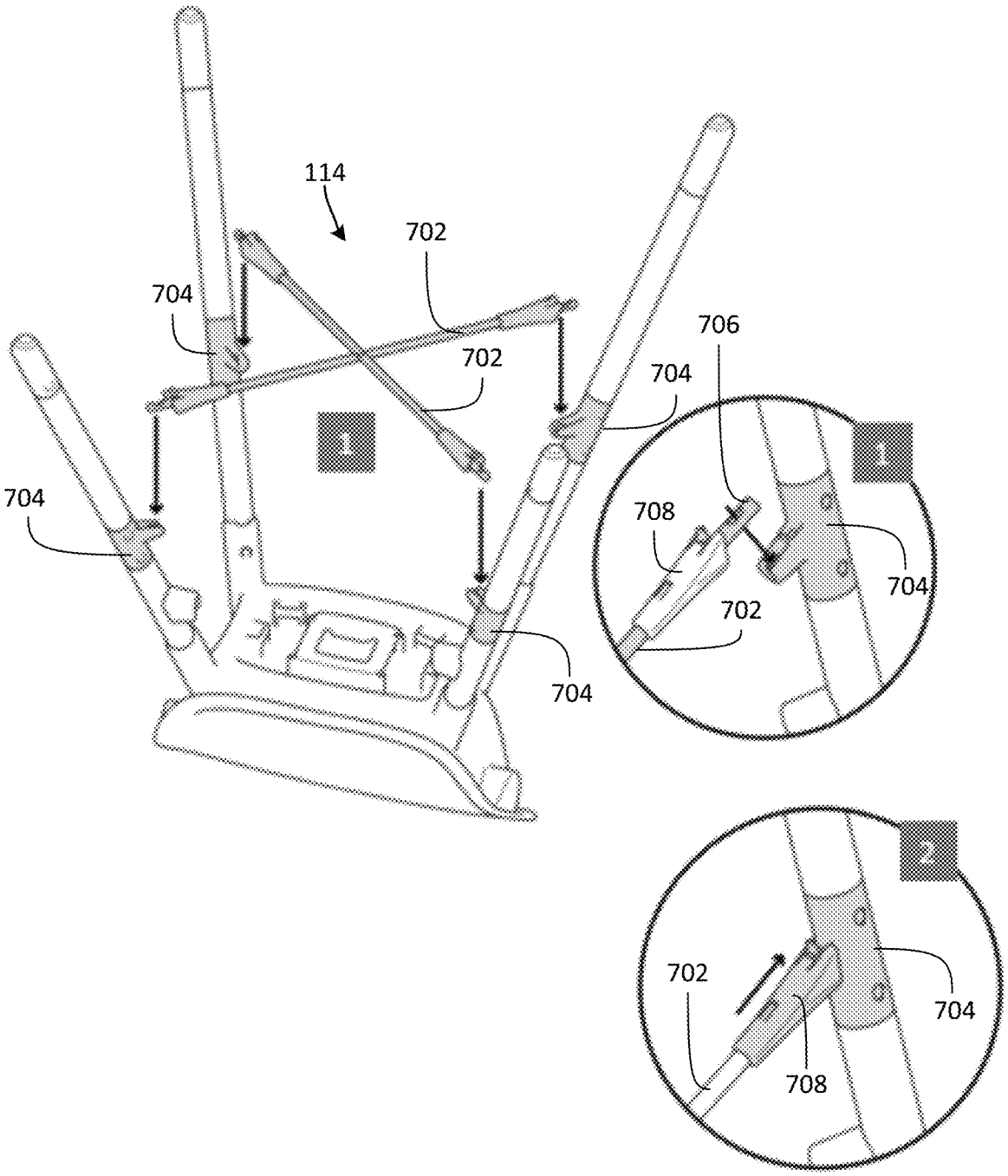
FIG. 7 illustrates a leg assembly of the convertible child chair of FIG. 1 and an example assembly process for a portion of the leg assembly.

FIG. 7 illustrates the leg assembly 108 and its components in greater detail. The cross-member assembly 114 may include a plurality of cross members 702 and a plurality of leg receivers 704. Each leg receiver 704 may be configured to be disposed between an upper leg portion 116 and a lower leg portion 118 of a leg. Each cross-member 702 may extend from one leg receiver 704 to another leg receiver 704 and may be removably coupled to the leg receivers 704.

Each cross-member 702 may include a finger 706 configured to be inserted into a leg receiver 704 and a cover 708 configured to cover the coupling of the finger 706 and leg receiver 704. For example, step 1 of FIG. 7 illustrates a finger 706 being inserted into a leg receiver 704, and step 2 illustrates the cover 708 having been slid over the coupling of the finger 706 and leg receiver 704.

Figure 8A:
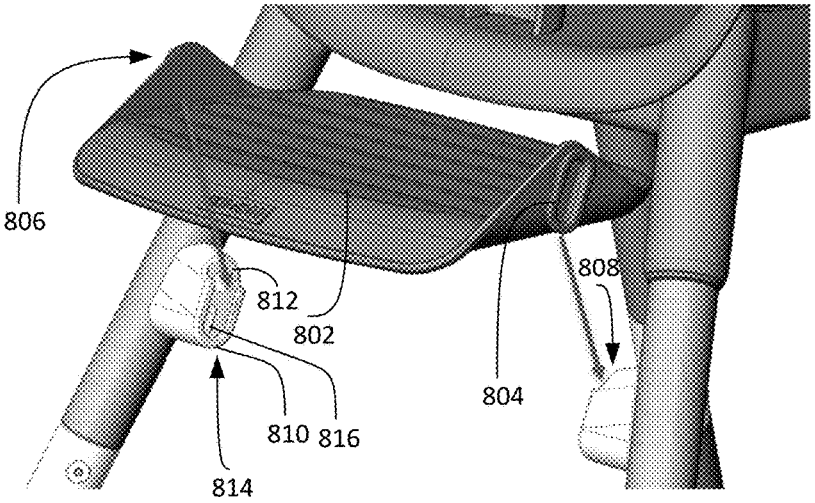
FIG. 8A is an enlarged view of a footrest and leg assembly portion of the convertible child chair of FIG. 1, with the footrest removed from the leg assembly.
Figure 8B:
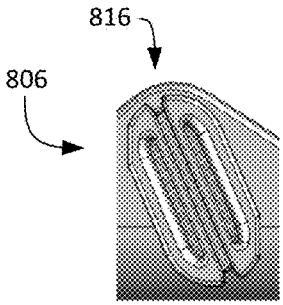
FIG. 8B is an enlarged end view of a portion of the footrest of FIG. 8A.

FIGS. 8A-10 are perspective views of a portion of the chair, illustrating convertible functionality of the footrest 110, which may include a base portion 802 on which a user of the chair may rest their feet, a first projection 804, and a second projection 806. Each projection 804, 806 may comprise a stadium shape (a rectangle with semicircles at a pair of opposite sides of the rectangle), in some embodiments. Each projection 804, 806 may mate with a corresponding slot 808, 814 in a front leg. Each slot 808, 814 may include a closed, rounded lower end 810 and an open upper end 812 so as to retain a projection 804, 806. In some embodiments, the first projection 804 may have one or more features different from the second projection 806, and the slot 808 may have one or more features different from the slot 814, the features of projection 804 may mate with the features of slot 814, and the features of projection 806 may mate with the features of slot 814 to prevent backwards installation of the footrest 110. For example, as shown in FIGS. 8A and 8B, the projection 806 may include a central slot 816 that mates with a rib 818 of the slot 814.

Figure 9:
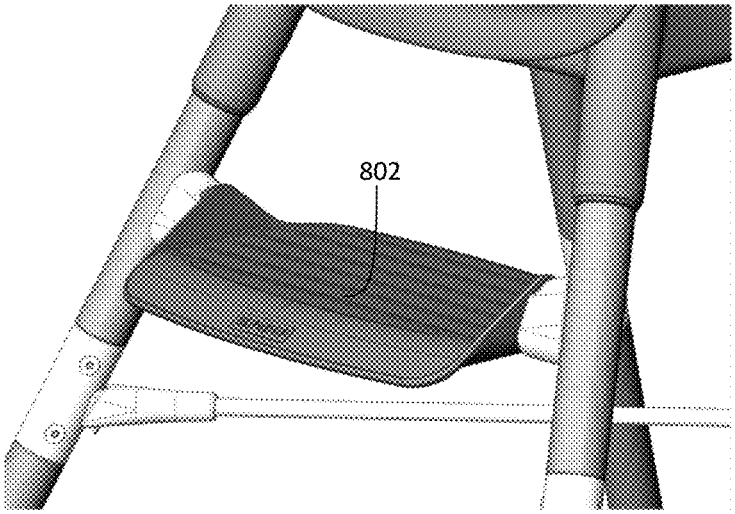
FIG. 9 is an enlarged view of the footrest and leg assembly portion FIG. 8A, with the footrest coupled to the leg assembly in a first orientation.
Figure 10:
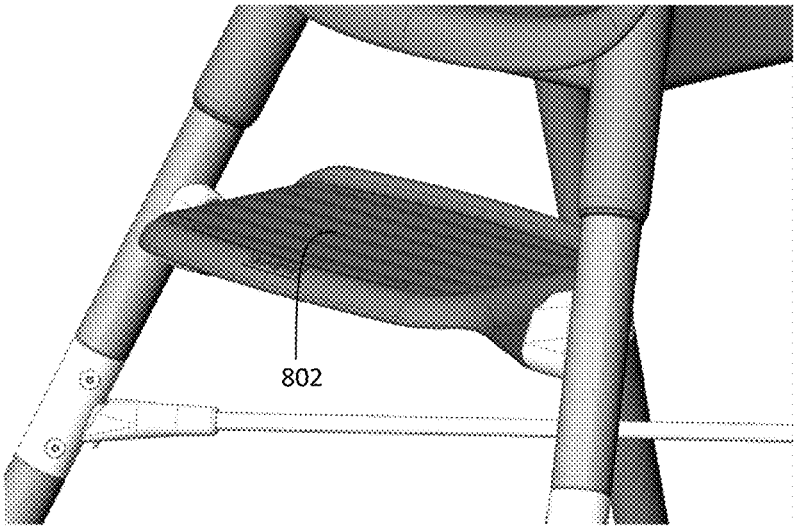
FIG. 10 is an enlarged view of the footrest and leg assembly portion FIG. 8A, with the footrest coupled to the leg assembly in a second orientation.

Due to the stadium shape of the projection 804, 806, the footrest 110 may be secured in the slots 808, 814 in a "down" orientation, as shown in FIG. 9, or in an "up" orientation, shown in FIG. 10. In addition, the base portion 802 of the footrest 110 may be vertically offset with respect to the projections 804, 806, such that the base portion 802 is higher in the "up" orientation than in the "down" orientation. As a result, the height of the footrest 110 may be adjusted by removing the footrest 110 from the leg assembly 108, flipping the footrest 110, and reinserting the projections 804, 806 into the slots 808, 814.

FIGS. 11A-11D are various views of a portion of the chair, illustrating attachment and features of the retainer band 106. The retainer band 106 may include a vertical central portion 1102 and two lateral portions 1104. The lateral portions 1104 may extend in opposed lateral directions from the vertical central portion 1102, and the vertical central portion 1102 may extend vertically downward from the intersection of the lateral portions 1104. The lateral portions 1104 may be configured to couple with the lateral portions 506 of the seat body 102, and the vertical central portion 1102 may be configured to couple with the seat portion 502 of the seat body 102. For example, the vertical central portion 1102 may include one or more projections 1106 that may be received by respective recesses 1108 in the seat portion 502, and each lateral portion 1104 of the retainer band 106 may include a projection 1110 that may be received in a respective recess 1112 in a lateral portion 506 of the seat body 102. The retainer band 106 may be coupled with the seat body 102 by first inserting the vertical portion projections 1106 into the seat portion recesses 1108 (as shown in FIG. 11B), then tilting the lateral portions 1104 towards the seat body 102 and inserting the lateral portion projections 1110 into the recesses 1112 in the lateral portions 506 of the seat body 102 (as shown in FIG. 11C). The lateral portion projections 1110 and seat body lateral portion recesses 1112 may include mating features, such as buttons 1114 (one of which is labelled in FIG. 11A) on the projections 1110 and a further recess within each recess 1112 to receive the button 1114, to enable the lateral portion projections 1110 to be secured within the lateral recesses 1112. Referring to FIG. 11D, the retainer band 106 may include one or more release buttons 1116, coupled to the mating buttons 1114, to release the mating buttons 1114 to permit the retainer band 106 to be uncoupled from the seat body 102.

Figure 12B:
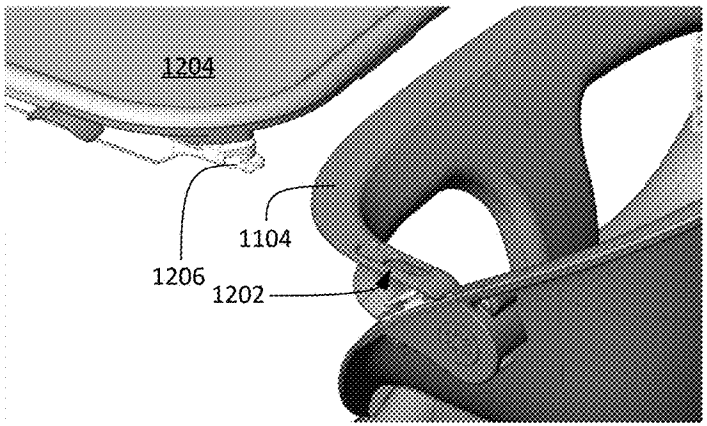
FIGS. 12A-12F are various view of a portion of the convertible child chair of FIG. 1, illustrating various functions and aspects of an example tray assembly.
Figure 12D:
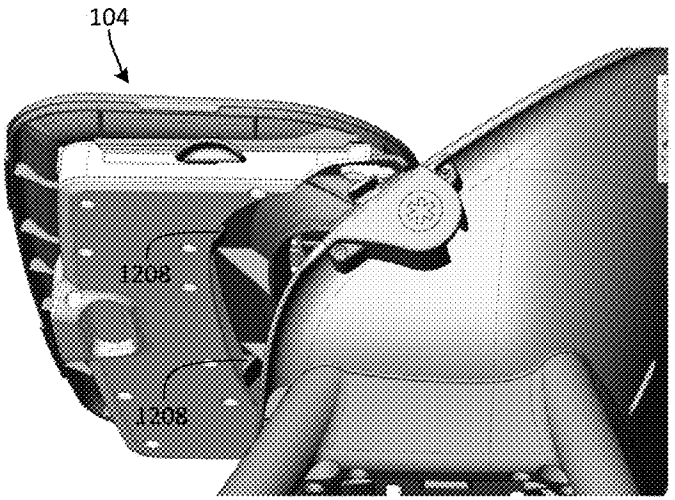
Figure 12A:
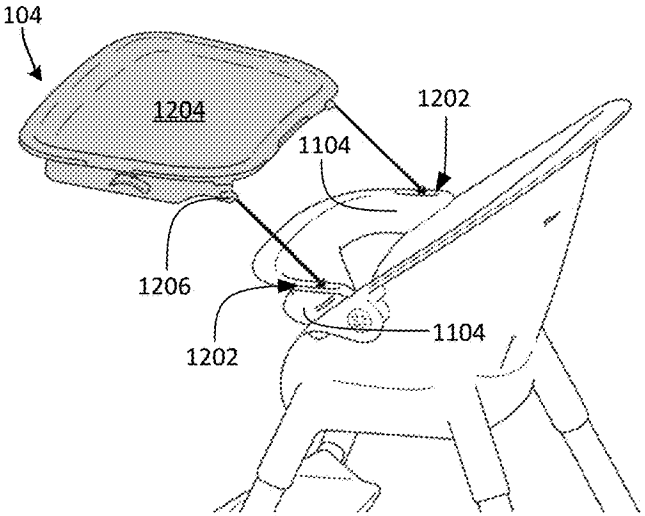
Figure 12C:
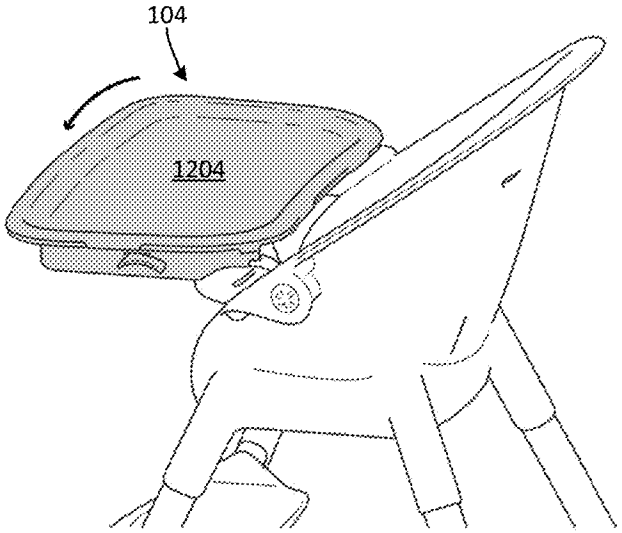

Referring to FIGS. 12A-12D, the retainer band 106 may further include, on the lateral portions 1104, tray assembly retainer slots 1202 with which a tray assembly 104 may be removably coupled. The tray assembly 104 may include a tray 1204 and two runners 1206. The runners 1206 may be configured to be removably, fixedly coupled to the lateral portions 1104 of the retainer band 106 by inserting the ends of the runners 1206 into the tray assembly retainer slots 1202. The tray assembly 104 may be secured to the retainer band 106 by, after inserting the runner ends into the tray assembly retainer slots 1202, tilting the tray assembly 104 down (as shown in FIG. 12C) until the bottom surface of the tray assembly 104 rests on the retainer band 106 and one or more latches 1208 (two such latches are included in the illustrated example, see FIG. 12D) on the tray assembly 104 to secure the tray assembly 104 to the retainer band 106. In some embodiments, when tray 104 is coupled to retainer band 106, runners 1206 physically block release buttons 1116 from being able to be activated. Thus, the retainer band 106 cannot be removed from seat body 102 when the tray 104 is coupled, in some embodiments.

Figure 12E:
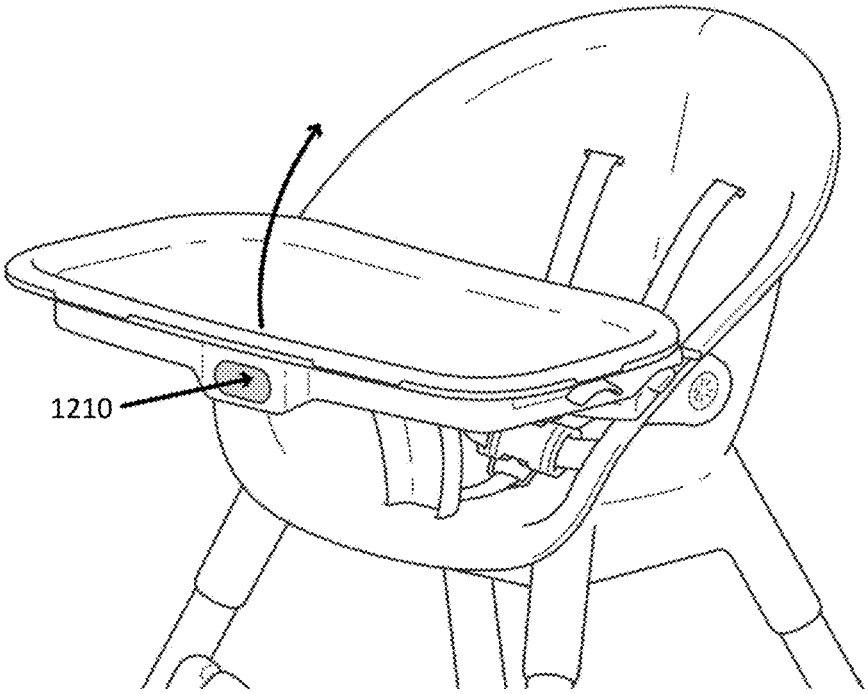

Referring to FIG. 12E, the tray assembly 104 may further include a release button 1210 which, when actuated by the user, releases the one or more latches 1208 to enable the tray assembly 104 to be removed from the retainer band 106. Accordingly, the one or more latches 1208 may release responsive to user actuation of the release button 1210.

Figure 12F:
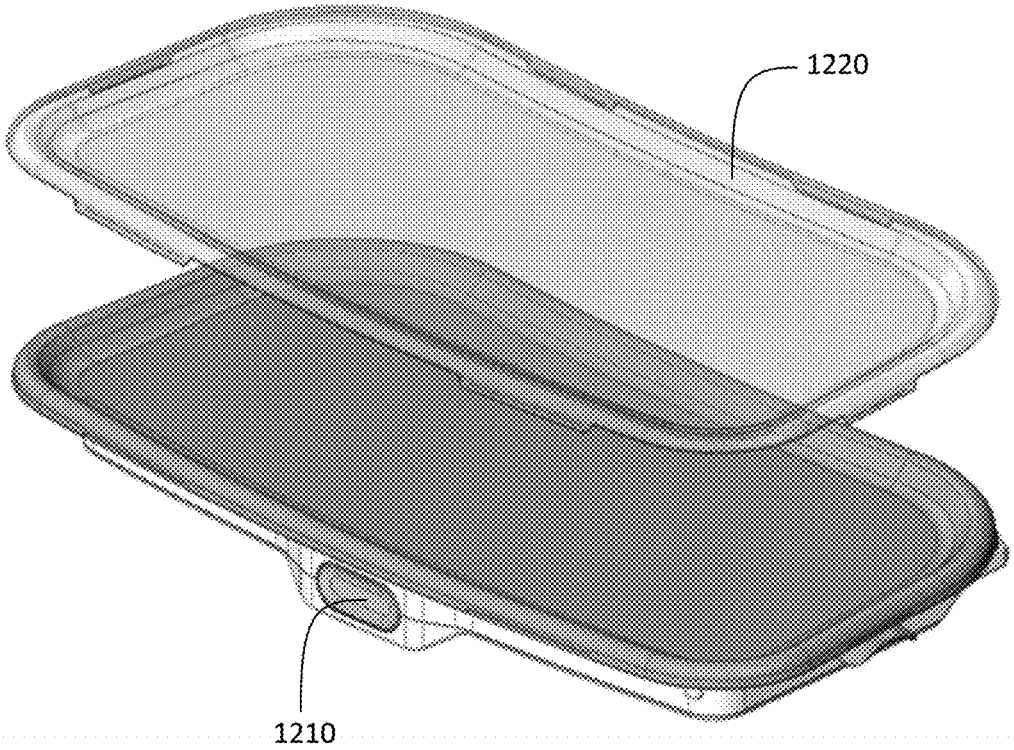

Referring to FIG. 12F, the tray 1204 may further include a tray liner 1220 that is removable from the body of the tray 1204 and may serve as a washable, easily replaceable outer layer of the tray 1204.

Figure 12G:
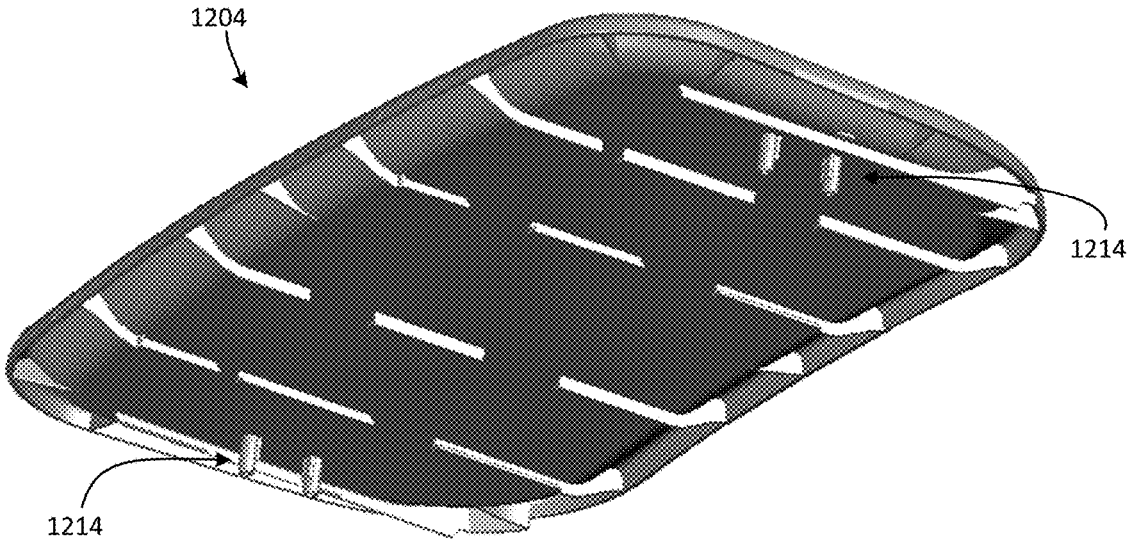
FIGS. 12G and 12H are perspective views of a tray and a base portion, respectively, of the tray assembly of FIGS. 12A-12E.
Figure 12H:
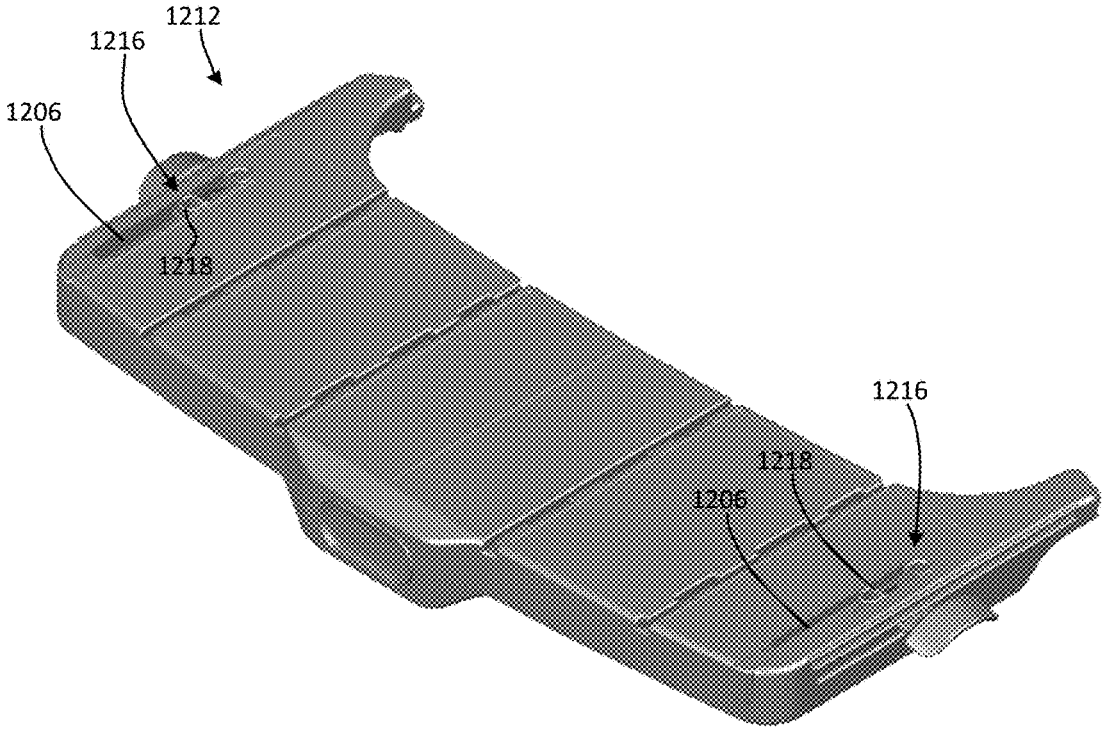
Figure 13:
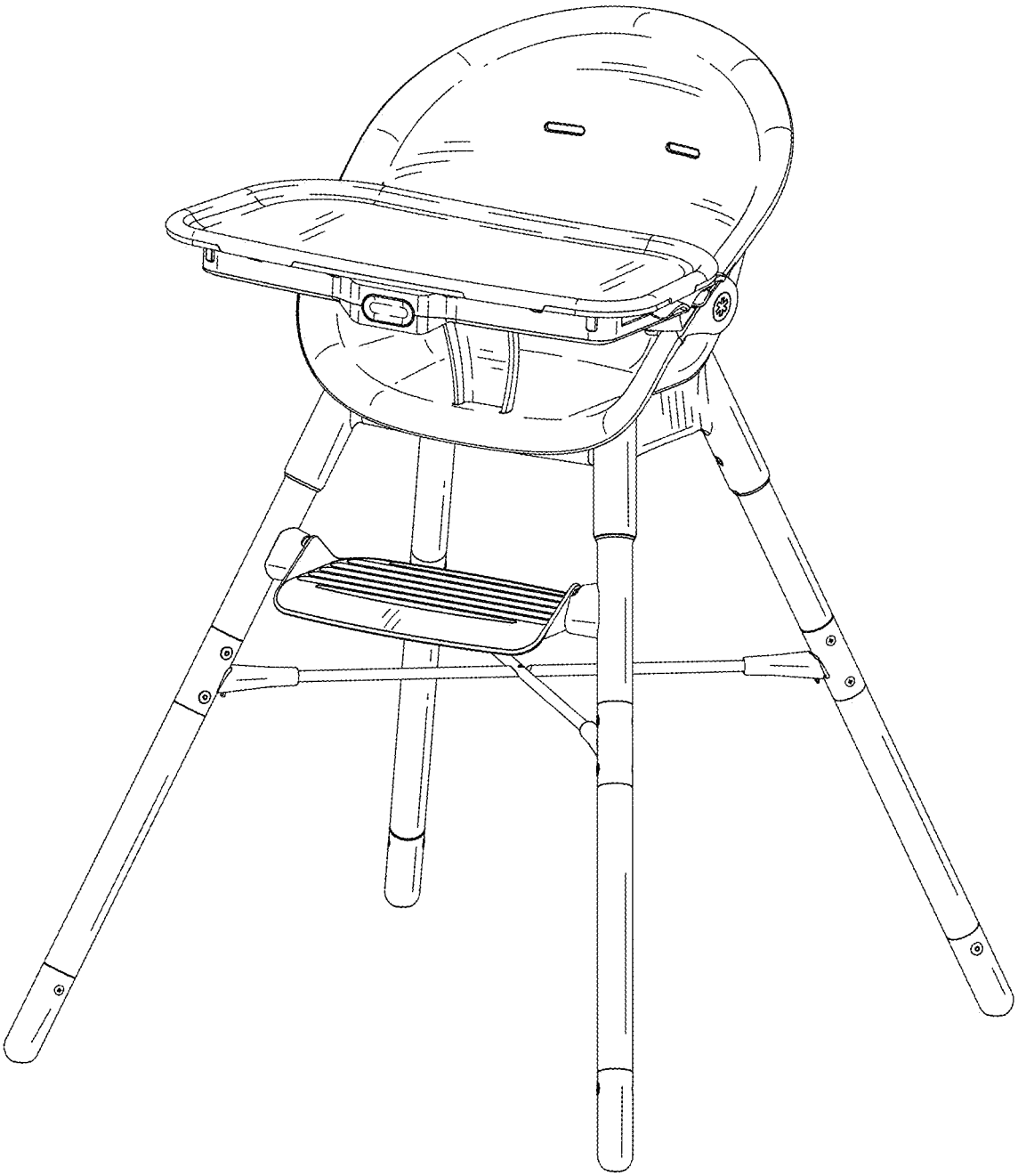
FIGS. 13-19 are various views of the convertible child chair.
Figure 14:
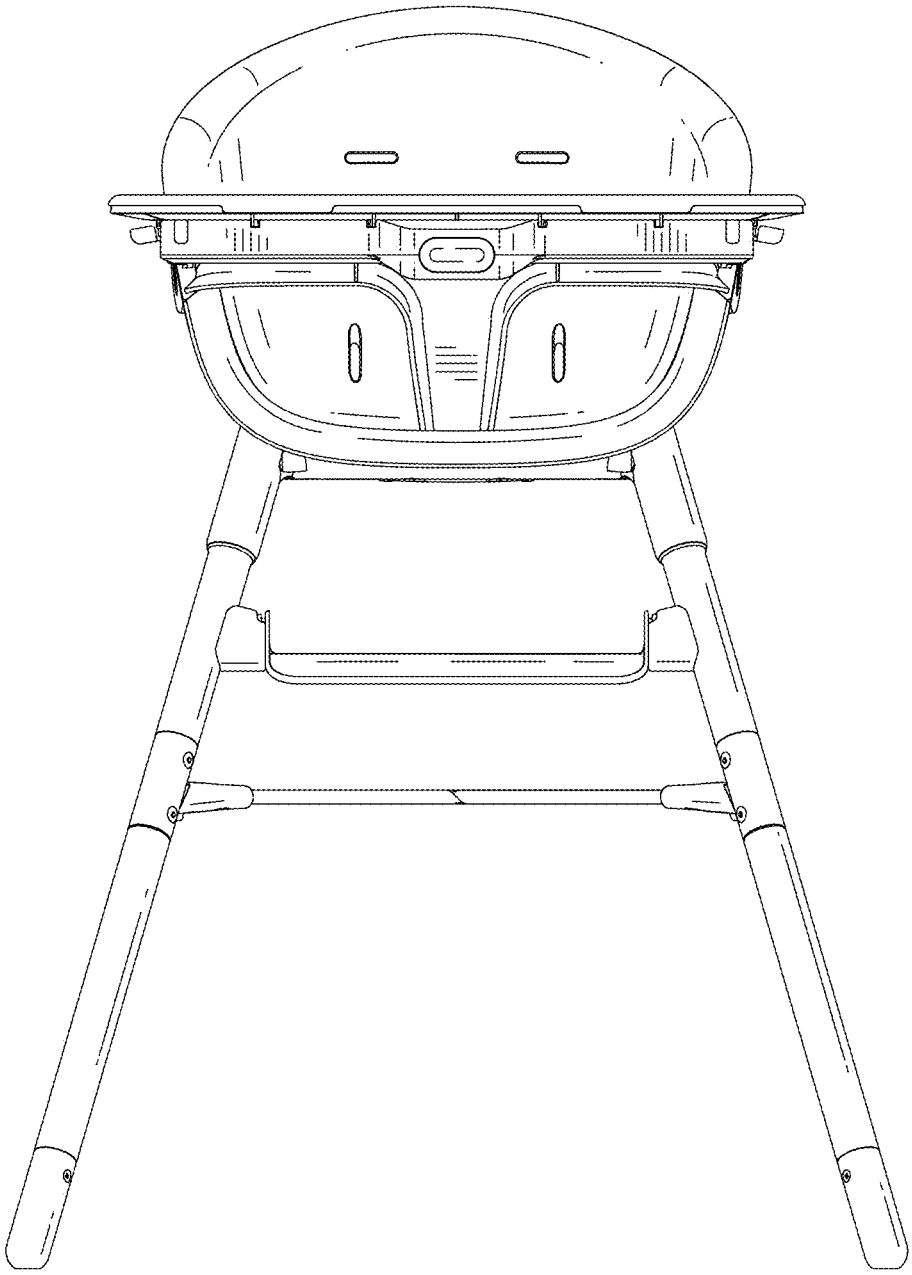
Figure 15:
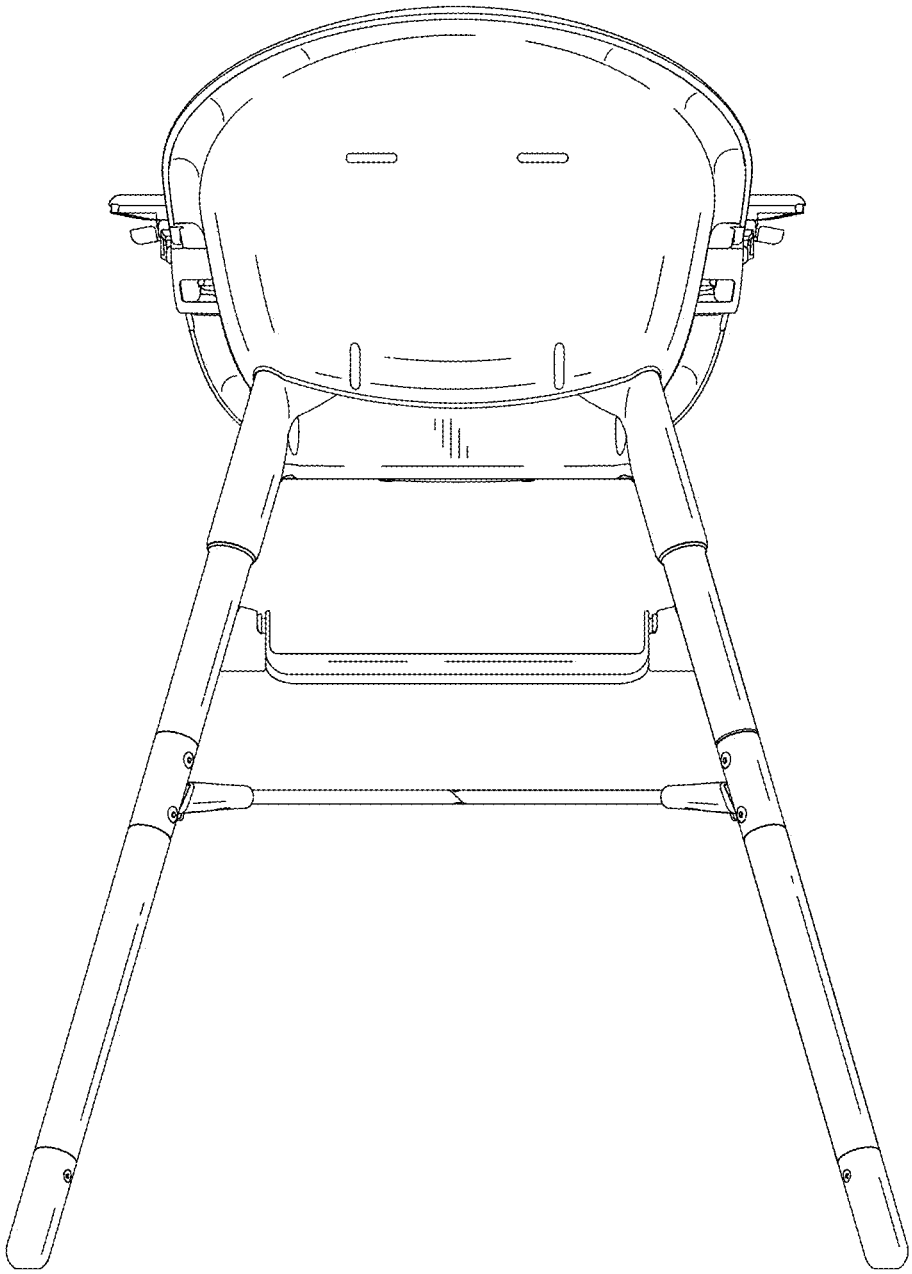
Figure 16:
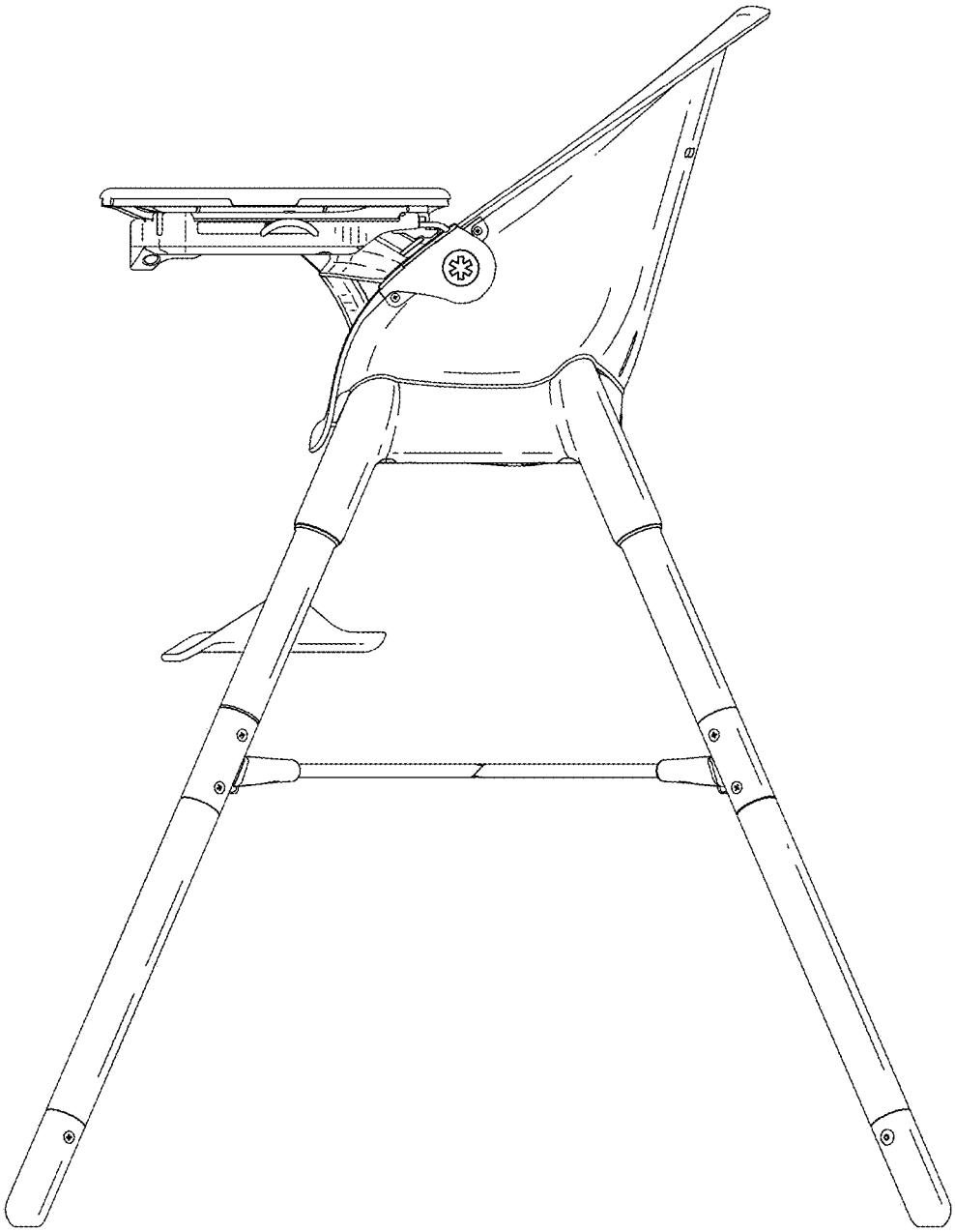
Figure 17:
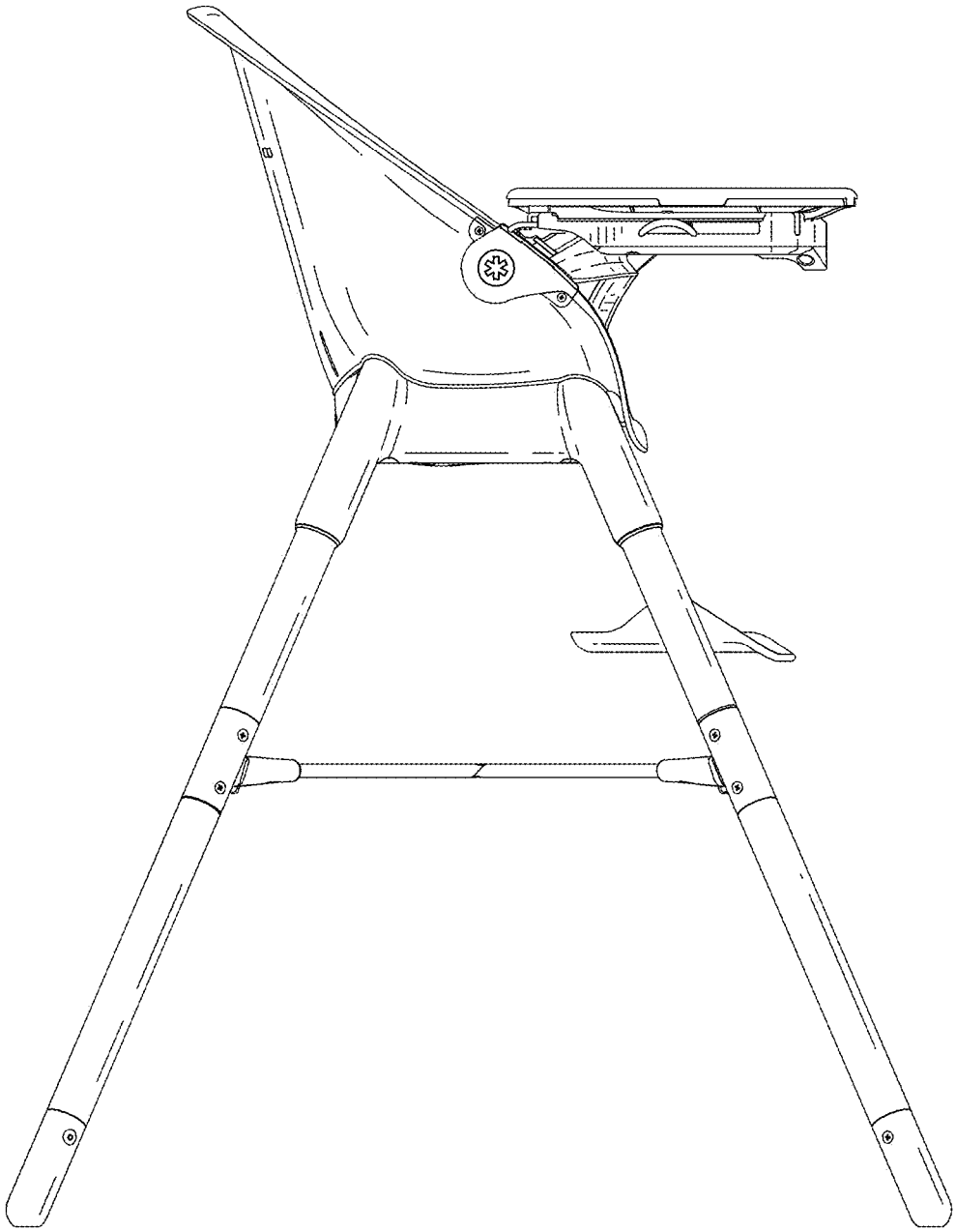
Figure 18:
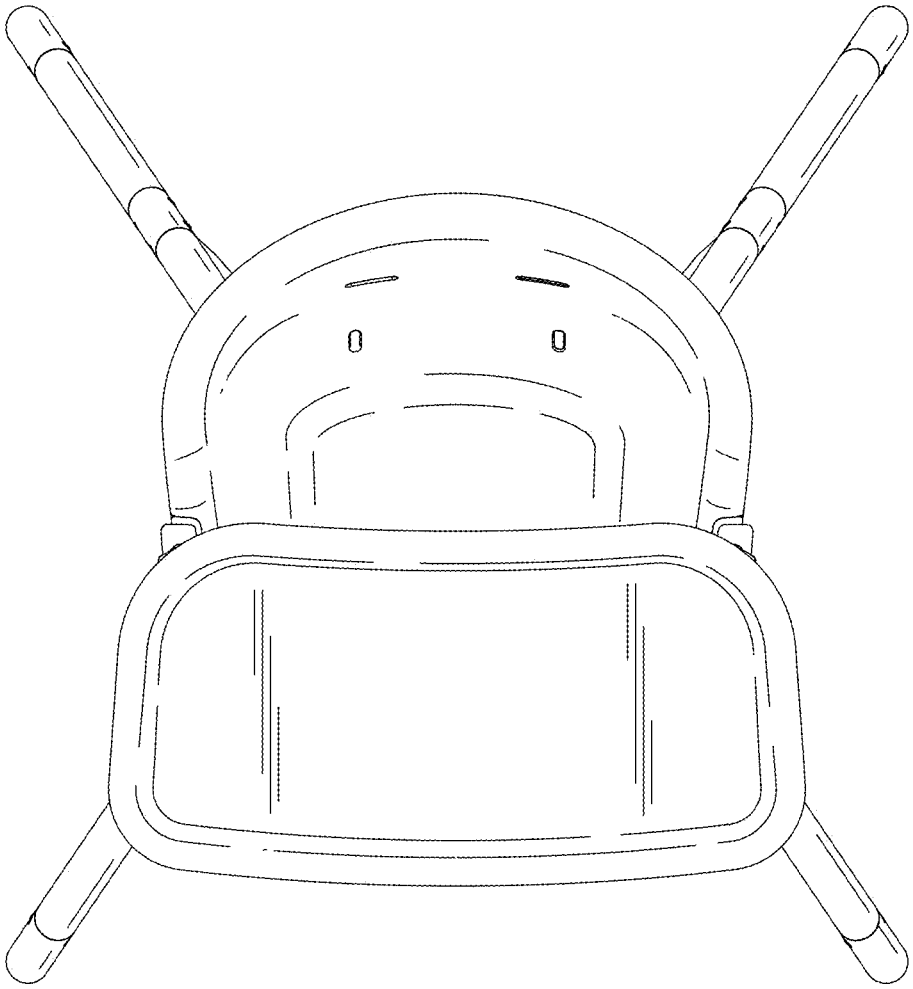
Figure 19:
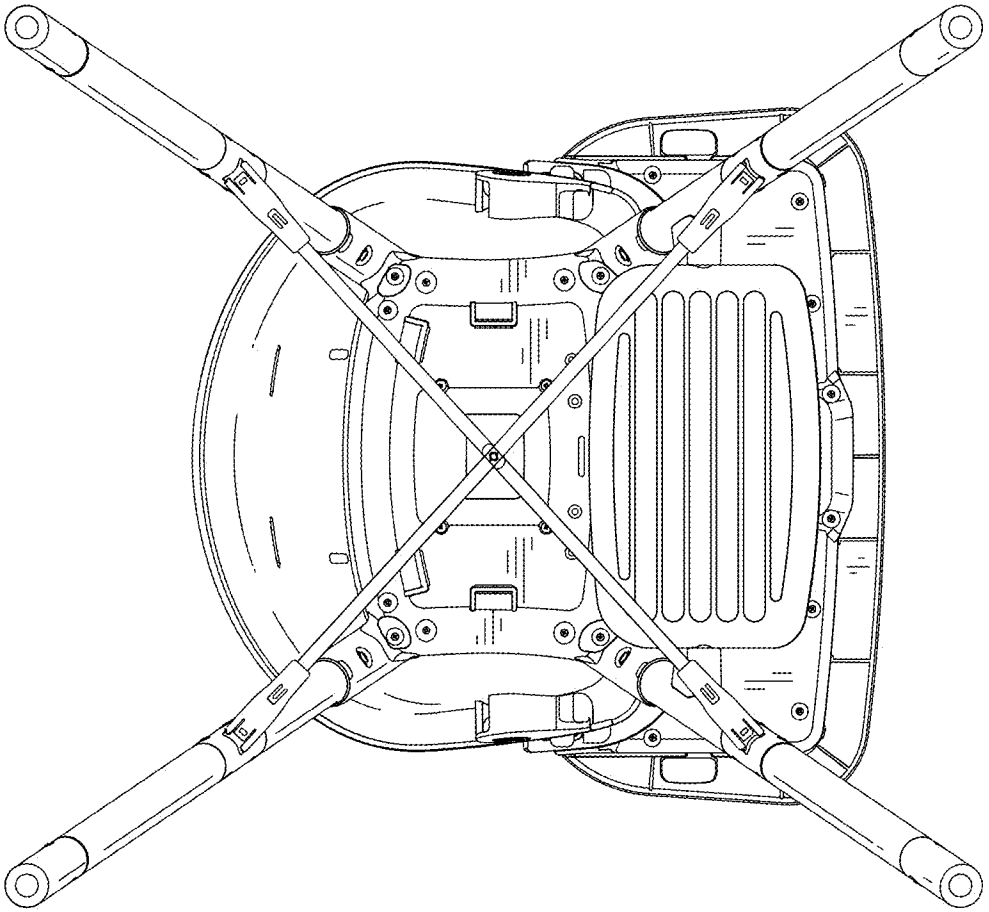

Referring to FIGS. 12F and 12G, the tray assembly may include a tray 1204 and a base portion 1212. The runners 1206 may be included in the base portion 1212, in some embodiments. The tray 1204 may be configured to slide on the runners 1206 relative to a body of the base portion 1212 so that the depth of the tray 1204 from the seat body 102 may be adjusted when the tray assembly 104 is coupled with the seat body 102 via the retainer band 106. The tray 1204 may be coupled with the base portion 1212. For example, the tray 1204 may include one or more projections 1214 that may be received by recesses 1216 in the base portion 1212. The recesses 1216 may be defined in a slider body 1218 that slides on a runner 1206 whereby the tray is coupled to the runners 1206 so as to be movable with respect to the base portion 1212. The base portion 1212 may include the latches 1208 (shown in FIG. 12D) and release button 1210 (FIG. 12E).

FIGS. 13-19 are various views of the convertible child chair, further illustrating the exterior surfaces and contours of the convertible child chair.

While this disclosure has described certain embodiments, it will be understood that the claims are not intended to be limited to these embodiments except as explicitly recited in the claims. On the contrary, the instant disclosure is intended to cover alternatives, modifications and equivalents, which may be included within the spirit and scope of the disclosure. Furthermore, in the detailed description of the present disclosure, numerous specific details are set forth in order to provide a thorough understanding of the disclosed embodiments. However, it will be obvious to one of ordinary skill in the art that systems and methods consistent with this disclosure may be practiced without these specific details.

What is claimed is:

1. A child chair comprising:
a seat body;
a retainer band removably coupled with the seat body, the retainer band configured to retain a child in the seat body when the retainer band is coupled with the seat body, the retainer band comprising:
a first lateral portion and a second lateral portion, each of the first and second lateral portions configured to be removably coupled with the seat body; and
a central portion, configured to be removably coupled with a seat portion of the seat body, wherein the first and second lateral portions extend laterally from the central portion;
a runner removably coupled with the retainer band;
a tray, coupled to the runner and configured to slide along the runner to adjust a depth of the tray from the seat body; and
a leg assembly comprising a plurality of legs and a cross-member assembly, wherein:
each leg comprises a lower portion and an upper portion, wherein the upper portion is removably coupled with the seat body, wherein the lower portion is selectively removably coupled with the upper leg portion and with the seat body, and
the cross-member assembly is configured to be coupled between the upper portion and the lower portion of each of the plurality of legs, and comprises a plurality of cross-members, each extending between two respective legs when the cross-member assembly is coupled with the legs.

2. The child chair of claim 1, wherein the runner is a first runner removably coupled to a first lateral side of the retainer band, the child chair further comprising:
a second runner removably coupled with a second lateral side of the retainer band, the tray coupled to the first and second runners and configured to slide along the runners to adjust the depth of the tray from the seat body.

3. The child chair of claim 1, further comprising a tray assembly, the tray assembly comprising:
the tray;
the runner;
a latch configured to secure the tray assembly to the retainer band; and
a release button coupled to the latch and configured to release the latch responsive to user actuation of the button.

4. The child chair of claim 3, wherein the tray assembly further comprises a base portion comprising the runner and the latch, the base portion configured to be coupled to the retainer band in a fixed position.

5. The child chair of claim 1, wherein the first and second lateral portions are configured to be removably coupled with first and second lateral portions of the seat body.

6. The child chair of claim 1, wherein each leg further comprises a foot, wherein the foot is selectively removably coupled with the upper leg portion and with the lower leg portion.

7. The child chair of claim 6, further comprising:
a first leg defining a first slot and a second leg defining a second slot;
a footrest configured to be removably coupled to the first and second legs, the footrest comprising:
a first projection configured to removably mate with the slot of the first leg; and
a second projection configured to removably mate with the slot of the second leg.

8. The child chair of claim 1, further comprising:
a first leg defining a first slot and a second leg defining a second slot;
a footrest configured to be removably coupled to the first and second legs, the footrest comprising:
a first projection configured to removably mate with the slot of the first leg; and
a second projection configured to removably mate with the slot of the second leg.

9. The child chair of claim 8, wherein the first projection and the second projection are configured to mate with the first and second slots in a first orientation in which the footrest is a first height and a second orientation in which the footrest is a second height.

10. A child chair comprising:
a seat body; and
a leg assembly coupled to the seat body, the leg assembly comprising:
a plurality of legs, each leg comprising:
a lower portion and an upper portion, wherein the upper portion is removably coupled with the seat body, wherein the lower portion is selectively removably coupled with the upper leg portion and with the seat body; and
a foot, wherein the foot is selectively removably coupled with the upper leg portion and with the lower leg portion; and
a cross-member assembly, the cross-member assembly configured to be coupled between the upper portion and the lower portion of each of the plurality of legs, the cross-member assembly comprising a plurality of cross-members, each extending between two respective legs when the cross-member assembly is coupled with the legs.

11. The child chair of claim 10, wherein each foot is further selectively removable coupled with the seat body.

12. The child chair of claim 10, wherein:
the cross-member assembly comprises:
a plurality of leg receivers, each leg receiver configured to couple with the upper portion and lower portion of a respective leg; and
each cross-member comprises:
a finger configured to be inserted into a leg receiver; and a cover configured to cover the coupling of the finger and leg receiver.

13. The child chair of claim 10, further comprising:

a footrest configured to be removably coupled to first and second legs of the plurality of legs, the footrest comprising:

a first projection configured to removably mate with a slot of the first leg; and a second projection configured to removably mate with a slot of the second leg.

* * * * *